US005746244A

United States Patent [19]

Woolley, Sr. et al.

[11] Patent Number: 5,746,244

[45] Date of Patent: May 5, 1998

[54] UNITARY THROAT PLATE/PUTTY PLATE FOR A FAUCET

[75] Inventors: Curtis Scott Woolley, Sr.; Arthur Corpuz Inocelda, both of Los Angeles, Calif.

[73] Assignee: Emhart Inc., Newark, Del.

[21] Appl. No.: 798,040

[22] Filed: Feb. 6, 1997

[51] Int. Cl.[6] ..... F16L 5/00

[52] U.S. Cl. ..... 137/359; 137/801; 4/678

[58] Field of Search ..... 137/359, 801; 4/678; 220/241, 242

[56] References Cited

U.S. PATENT DOCUMENTS

| | | | |
|---|---|---|---|
| 3,448,768 | 6/1969 | Keller, III . | |
| 3,590,876 | 7/1971 | Young . | |
| 3,871,406 | 3/1975 | Anderson | 137/801 |
| 4,313,469 | 2/1982 | Johnson . | |
| 4,356,574 | 11/1982 | Johnson . | |
| 4,387,738 | 6/1983 | Bisonaya et al. . | |
| 4,513,769 | 4/1985 | Purcell | 137/801 |
| 4,552,171 | 11/1985 | Farrell et al. | 137/801 |
| 4,649,958 | 3/1987 | Purcell | 137/801 |
| 5,073,991 | 12/1991 | Marty . | |
| 5,131,428 | 7/1992 | Bory . | |
| 5,165,121 | 11/1992 | McTargett et al. . | |
| 5,368,071 | 11/1994 | Hsieh . | |
| 5,555,912 | 9/1996 | Saadi et al. | 137/801 |

*Primary Examiner*—Denise L. Ferensic
*Assistant Examiner*—John Ball
*Attorney, Agent, or Firm*—Harold Weinstein

[57] ABSTRACT

A faucet 10 having a copper tube waterway 44 assembled to hot water valve 40 and cold water valve 42 to control the discharge of water for the waterway 44, and a housing 12 with a base 14 and a spout 16 formed therein. A unitary member 74 including a throat plate 76 is connected to cover the spout 14 and mount the waterway 44 therein, and a putty plate 78 to cover the base 14 and be connected thereto by fasteners 94. The connection of the throat plate 76 to the spout 14 is by ribs 116 that wedgingly engage bosses 56 of the spout 14 to interconnect the spout 14 and the throat plate 76 and simultaneously mount the waterway 44 therebetween.

4 Claims, 6 Drawing Sheets

UNITARY THROAT PLATE/PUTTY PLATE FOR A FAUCET

BACKGROUND OF THE INVENTION

This invention relates to a unitary member for a faucet that includes a copper tube waterway assembled in a hollow housing. The unitary member, including the throat plate and the putty plate, is assembled to the housing to act as a water seal and to mount the waterway within the housing while enclosing the housing.

This type of faucet uses a waterway mounted with a hollow housing having a base and a spout to operate in a well known manner. The unitary member is affixed to the housing as by fasteners at its putty plate and an improved non-fastener interconnection of parts wedged into assembled position to enclose the housing spout and affixed the waterway therebetween. Independent and illustrated in U.S. patent application Ser. No. 08/535,692 and U.S. Pat. No. 5,566,707.

Prior Art faucets required both the putty plate and the throat plate to be connected to the housing mechanically with fastening means. Also, means had to be provided to interconnect the throat plate to the putty plate. This type of construction required individual components and these connections to be of sufficient strength and exposed the faucet to more locations of possible structural flaws or failures. It also made assembly of the faucets more complex and expensive. Thus, there is a need to simplify the assembly while improving the overall strength and appearance of the faucet.

SUMMARY OF THE INVENTION

In light of the need expressed above, it is an object of this invention to provide an assembly of a faucet having a copper tube waterway mounted in a hollow housing enclosed by a unitary member including a throat plate and a putty plate.

Another object of this invention is to use a unitary member having a putty plate that provides a water seal for the faucet and a throat plate that covers the open spout of the housing and is affixed to the housing without separate fasteners to mount the waterway therein.

Still another object of the invention is to reduce assembly time of the faucet, provide a non-deformable unitary throat plate/putty plate that is structurally sound that does not require separate fasteners to interconnect the throat plate to the putty plate, or the throat plate to the housing.

With this and other objects in mind, this invention contemplates a faucet having a unitary member including a throat plate and a putty plate, with the putty plate connected to the housing by fasteners and the throat plate connected to the housing without separate fasteners. In this way, the housing openings in the spout and the base thereof are enclosed by the unitary member to mount the waterway therein.

Another object of the invention is to provide a unitary member in which the throat plate enhances the cosmetic appearance of the faucet.

Other objects, features and advantages for the present invention will become more fully apparent from the following detailed description of the preferred embodiment, the appended claims and the accompanying drawings.

DESCRIPTION OF THE PREFERRED EMBODIMENT

Figure 1:
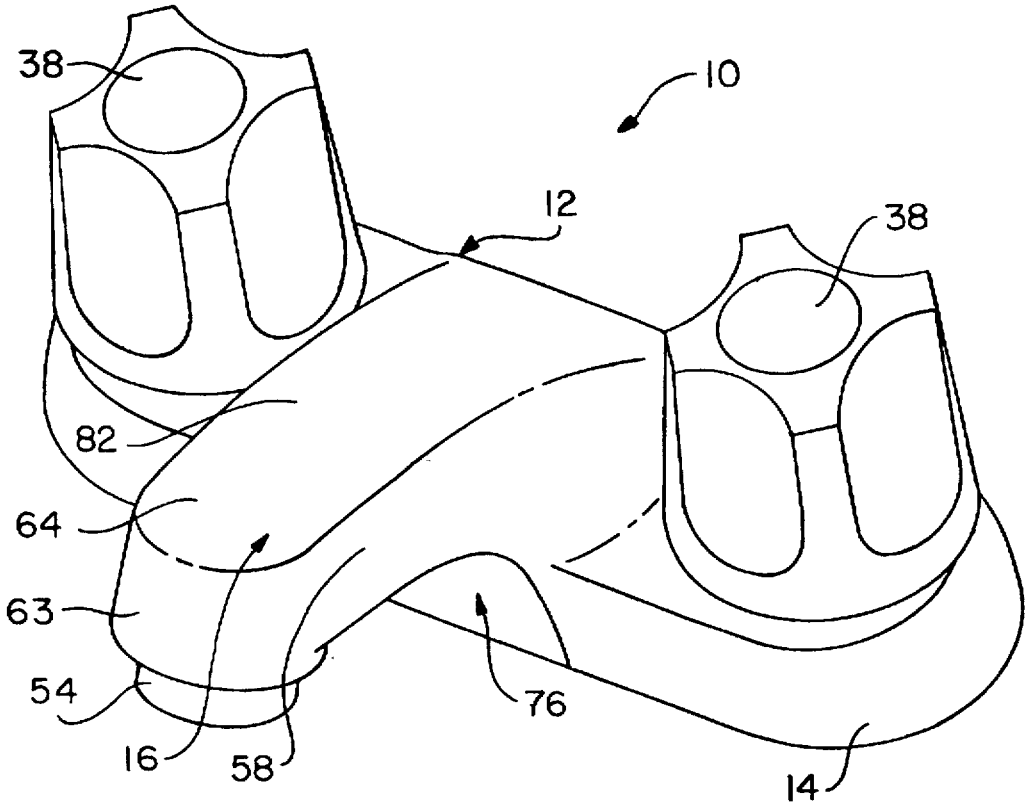
FIG. 1 is a perspective view showing a faucet embodying the present invention.
Figure 2:
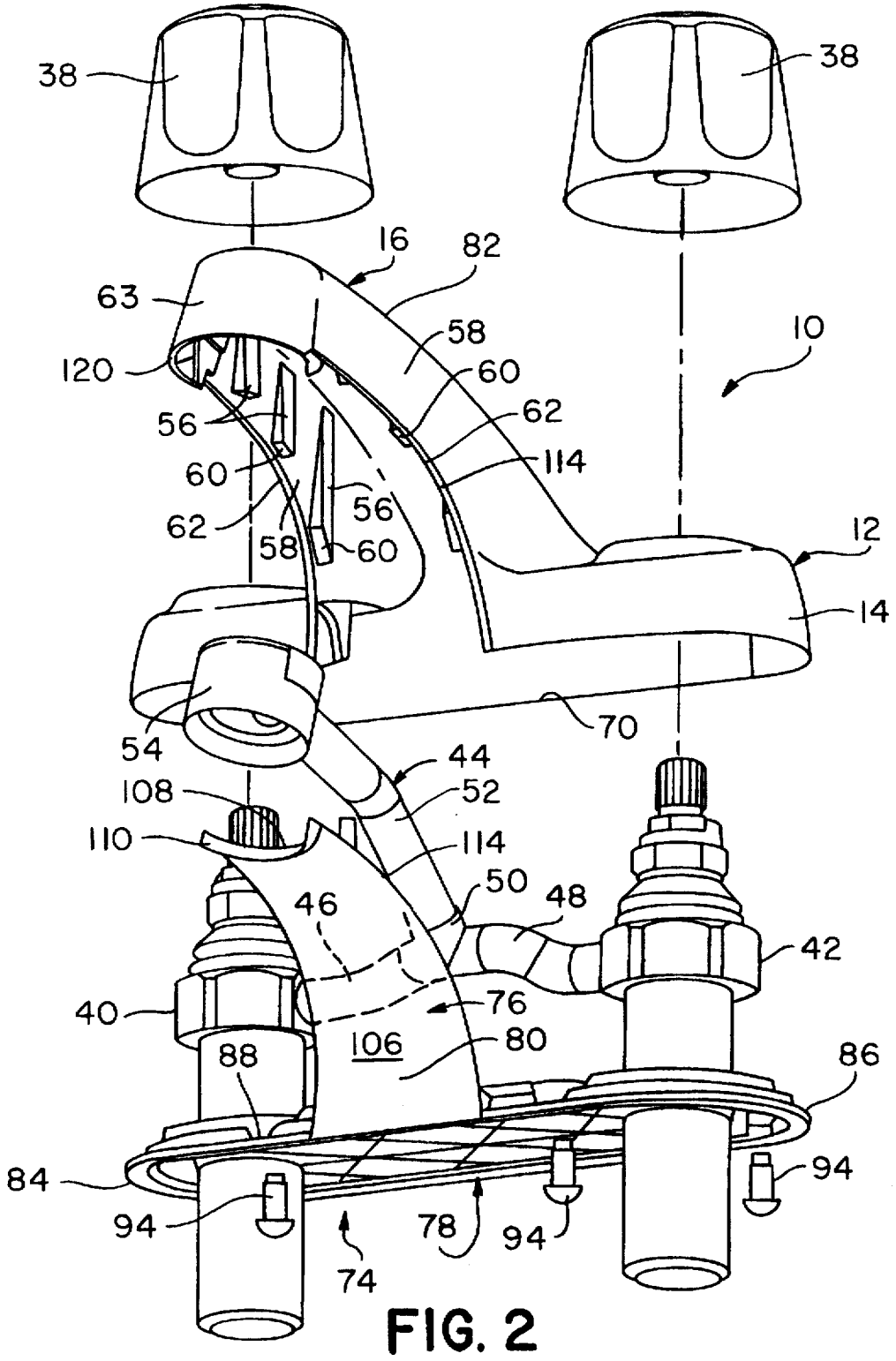
FIG. 2 is an exploded perspective view of the faucet of FIG. 1 showing the unitary member which includes the throat plate and the putty plate.
Figure 3:
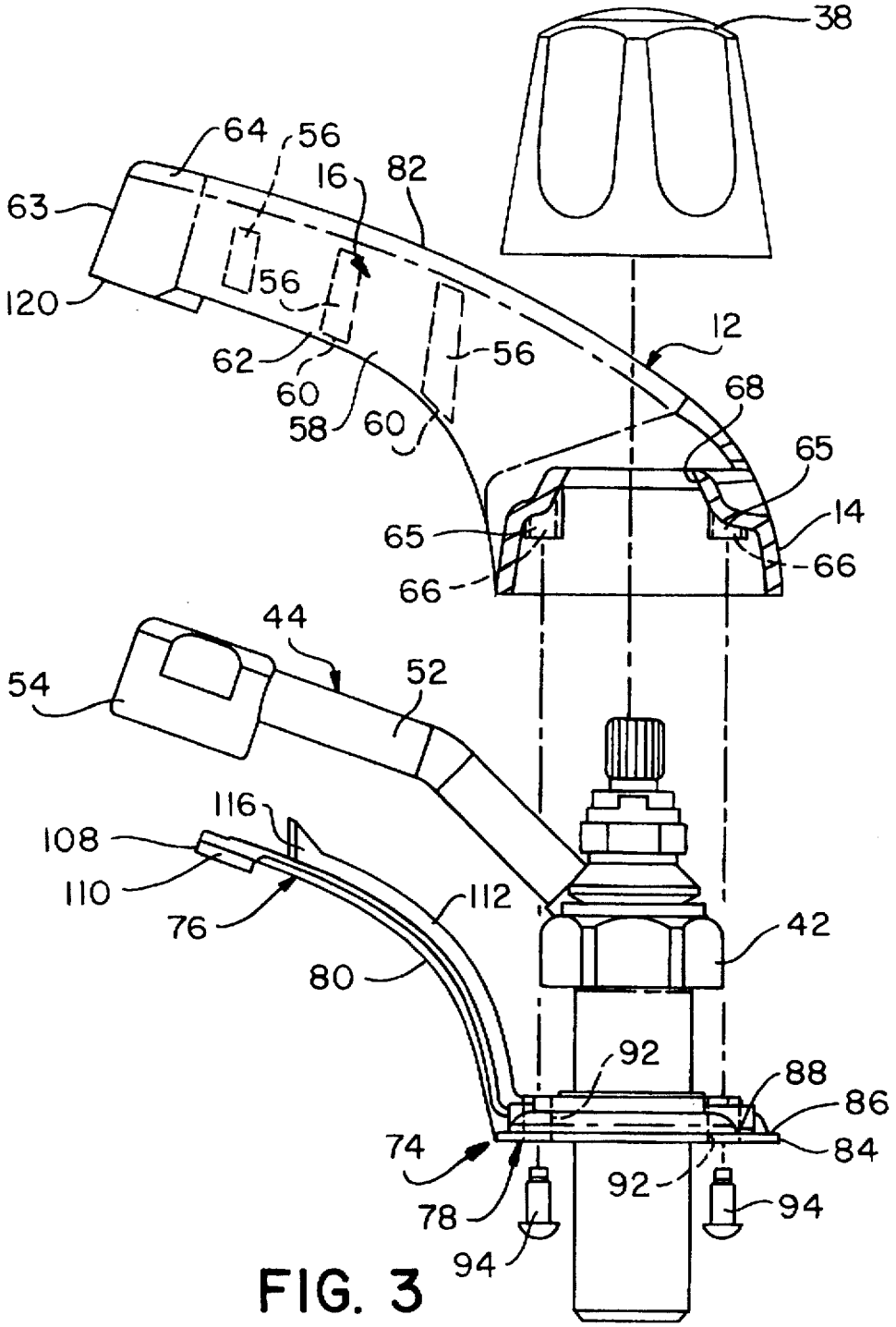
FIG. 3 is an exploded side view of the faucet of FIG. 1.
Figure 4:
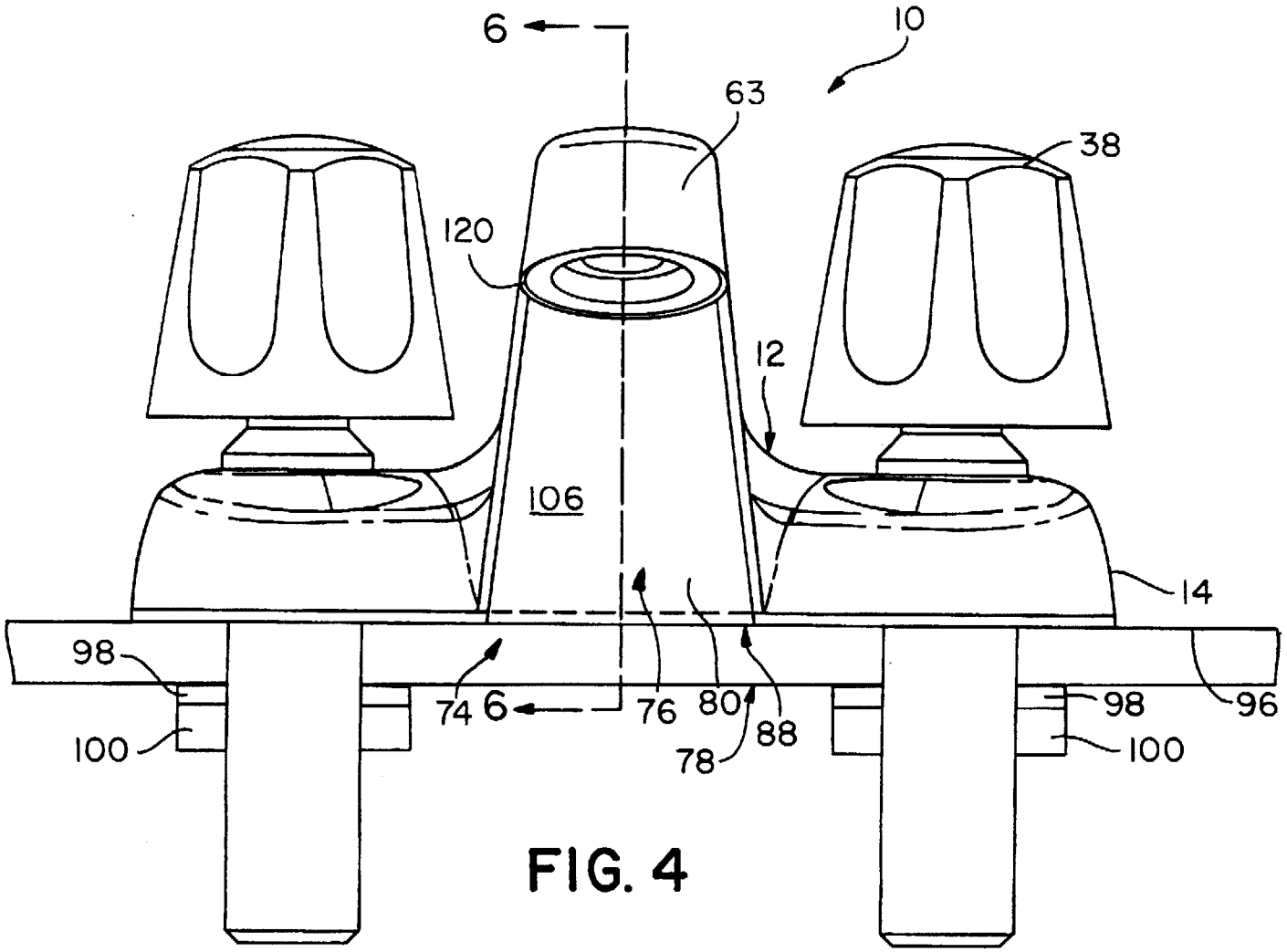
FIG. 4 is a front elevational view of the faucet of FIG. 1.

As shown in FIGS. 1 through 5, a faucet 10 depicting the preferred embodiment of the invention, is formed with a housing 12 having a base 14 and a spout 16 extending outwardly from a central portion thereof. A pair of handles 38 are located on the top of the base 14 on opposite sides of a rear portion of the spout 16. The handles 38 are affixed to hot water valve 40 and cold water valve 42, respective, as shown in FIGS. 2,3 and 4.

The faucet 10 includes a copper tube waterway 44 assembled to the valves 40 and 42, as shown in FIGS. 2 and 3, which is enclosed in the housing 12 as more fully described hereinafter. The water is carried from the valves 40 and 42 in arms 46 and 48 which deliver the water to a "T" fitting 50 from which spout leg 52 extends to a discharge head 54. The discharge head 54 is adapted to receive a suitable aerator (not shown) in assembled position. The arms 46 and 48 and the "T" fitting 50 of the waterway 44 are disposed within the base 14 of the housing 12, and the spout leg 52 and discharge head 54 of the waterway 44 are disposed within the spout 16 of the housing 12.

Various views of the shell of the housing 12 are shown in FIGS. 2,3 and 4. In particular, FIGS. 2 and 3 show spaced side bosses 56 formed on opposite side wall 58 of the spout 16 with the outer edges 60 of the two bosses 56 closest to the base 14 being slightly recessed from the edges 62 of the spout 16. The bosses 56 nearest to the discharge head 54 may be spaced further from the edges 60 for purposes described hereinafter. The side walls 58 extend into an arcuate end wall 63 that smoothly is connected across the side walls 58 to join each of the side walls with a top wall 64 that extends across the side walls 58 from the base 14 to the end wall 63. Two sets of bosses 65 with holes 66 are each formed in the base 14 adjacent a pair of holes 68 which are formed therein to receive the valves 40 and 42 as shown in FIGS. 2,3 and 4. The base 14 as shown best in FIG. 5 is formed with an inner opening 70 and has a perimeter edge 72 formed around the opening to define a boundary thereof.

Figure 5:
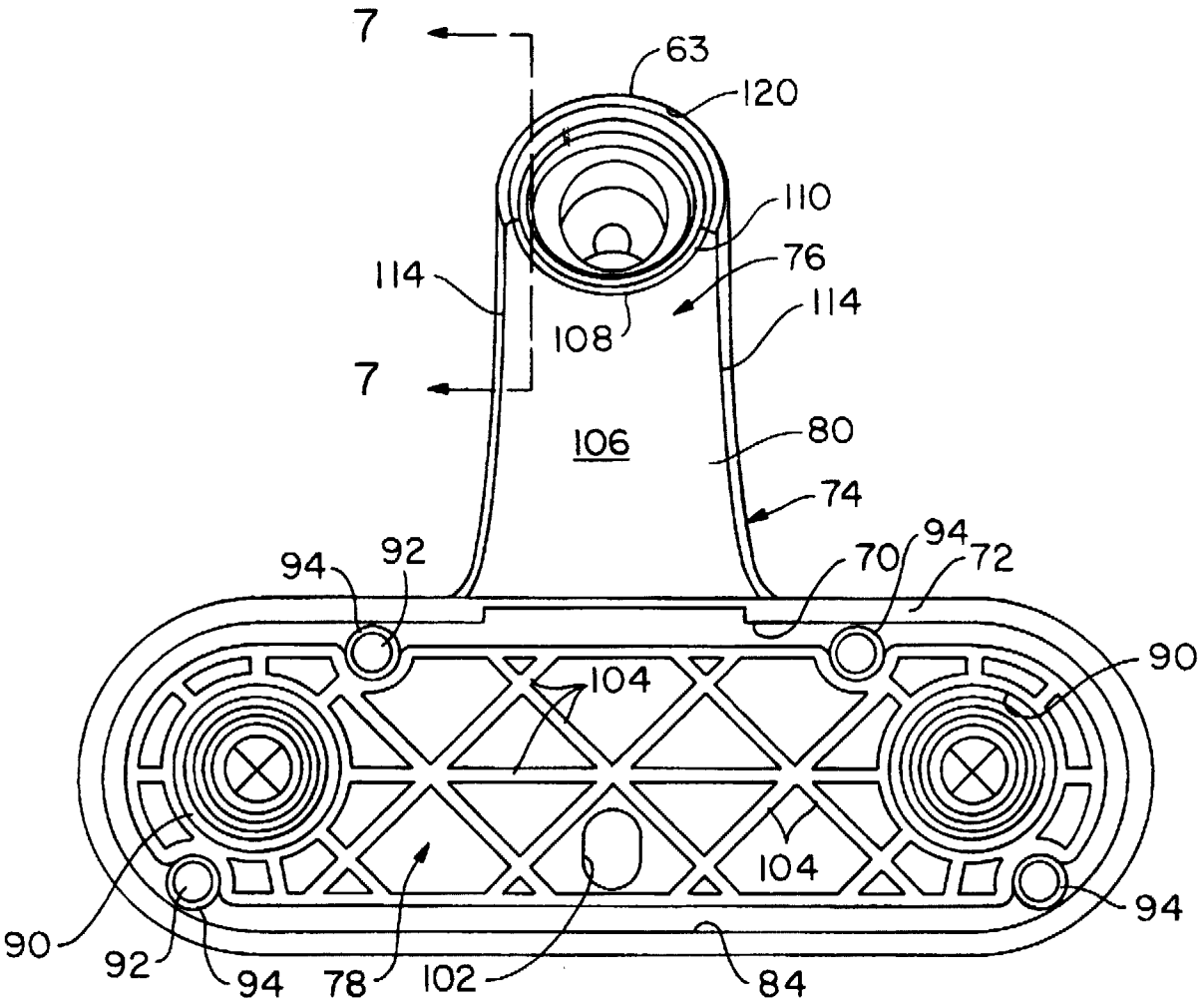
FIG. 5 is a bottom view of the faucet of FIG. 1.
Figure 7:
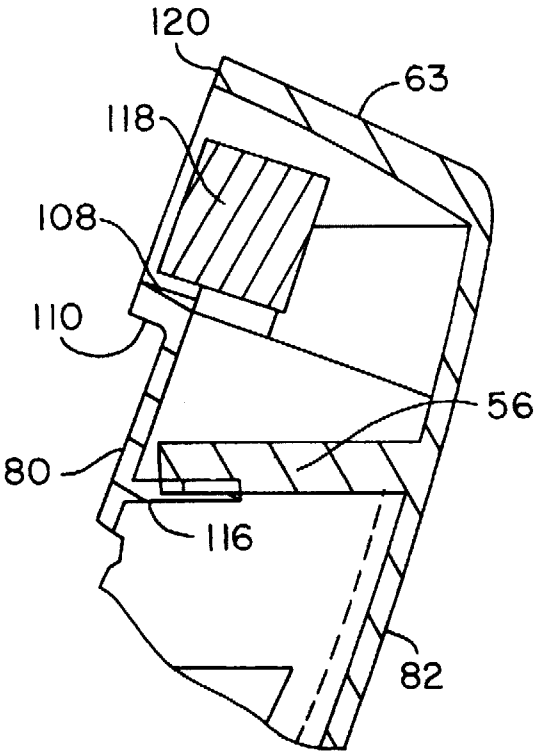
FIG. 7 is a sectional view taken along line 7—7 of FIG. 5 showing the wedge connection between the throat plate and the housing.
Figure 6:
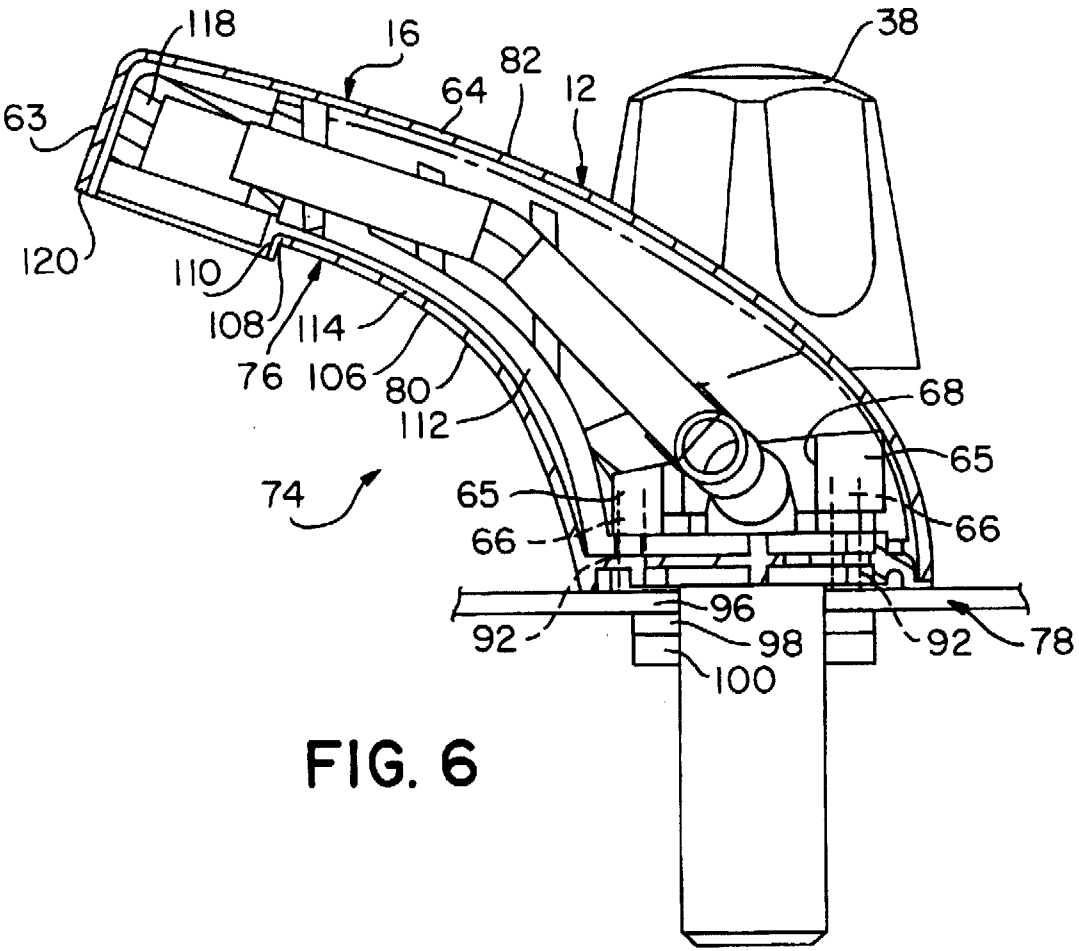
FIG. 6 is a sectional view taken along line 6—6 of FIG. 4 showing the copper tube waterway in assembled position.

A unitary member 74 shown in FIGS. 2,3 and 5 including a throat plate 76 and a putty plate 78. The throat plate 76 forms a lower body 80 which will close the opening of the "U" shaped spout 16 of the housing 12 which defines an upper body 82. The putty plate 78 provides a water seal and structurally supports the waterway 44 of the faucet 10 when joined to the housing 12. Thus the unitary member 74 acts to seal the faucet 10 and cosmetically enhance the final assembly thereof while securing the waterway 44 therein. The putty plate 78 is shown in FIGS. 2 through 5 and may be made of a suitable rubber or plastic material. The putty plate 78 has a perimeter edge 84 which generally conforms to the shape and size of the base 14 of the housing 12. A ledge 86 formed at the perimeter edge 84 has the perimeter edge 72 of the base 14 extend over the putty plate 78 to cover the same in the assembled position shown in FIGS. 1 and 6. The putty plate 78 has a raised floor 88 shown in FIGS. 2 and 3, and a pair of holes 90 therein shown best in FIG. 5 through which the valves 40 and 42 extend. The holes 90 of the putty plate 78 are aligned with the holes 68 of the base 14 (FIGS. 2 and 6). A pair of openings 92 at each of the holes 90 are formed in alignment with the holes 66 of the bosses 64 of the base 14 and through which fasteners 94 pass through to be threadedly received in the holes 66 of the bosses 64 to secure the putty plate 78 to the base 14. Thereafter, the valves 40 and 42 are secured to a countertop 96 by a washer 98 and a nut 100 shown in FIG. 4. The putty plate 78 has an opening 102, shown in FIG. 5, for a drain stop actuator shaft (not shown). The raised floor 88 has a plurality of criss-crossed reinforcing ribs 104 formed on its upper and lower sides as is illustrated best in FIG. 5 showing only the bottom side thereof, but the top side will be substantially a mirror image thereof. The putty plate 78 substantially encloses the open bottom of the base 14 and will be sealed against the countertop 96. The throat plate 76 is formed integrally with the putty plate 78 and extends from the center thereof to cover the open bottom of the spout 16 of the housing 12. The throat plate 76 defines a lower body 80 while the spout 16 defines an upper body 82. The throat plate 76 has an arcuate central body 106, the end 108 of which is concave and shaped with substantially the same radius as the circular discharge head 54 of the waterway 44. The end 108 has a downturned lip 110 that extends therefrom. Laterally spaced strengthening ribs 112 extend inwardly of the side edges 114 of the body 106 on the upper side thereof, each terminating in raised ribs 116 which extend at a slightly forward angle from the upper side of the body 106. The raised ribs 116 are positioned to engage the side bosses 56 formed nearest the end wall 63 as shown best in FIG. 7 to wedgingly engage the side bosses 56 and cause the throat plate 76 to nest against and smoothly cover the open bottom of the spout 16. The upper side of the central body 106 of the throat plate 76 adjacent the side edges 114 will contact the lower ends of the side bosses 56 formed along the side walls 58 to form a solid structure therewith.

The end wall 63 and the side walls 58 have an arcuate boss 118 formed on the inside with a radius substantially equal to that of the discharge head 54 of the waterway 44 so that when the raised ribs 116 are wedged against the side bosses 56, the discharge head 54 will be clamped between the arcuate boss 118 of the housing end wall 62 on the forward side thereof and the arcuate end 108 of the throat plate 76 on the base 14 side thereof. The end wall 62 has an edge 120 that is lower than the edge 60 of the spout 14 but lies in the same plane as that of the lower edges of the lip 110 of the throat plate 76 and the discharge head 54 of the waterway 44.

In general, the above-identified embodiment is not to be construed as limiting the breadth of the present invention. Modifications and other alternative constructions will be apparent which are within the spirit and scope of the invention as defined in the appended claims.

What is claimed is:

1. A faucet having a copper tube waterway assembly connected to hot and cold water valves to control the discharge of water from the waterway comprising:

a. a unitary member having a throat plate, and a putty plate through which the valves extend, b. a hollow housing forming a cover for the waterway assembly and through which the valves extend, c. fastening members connecting the putty plate of the unitary member to the housing, d. the waterway assembly having a spout and a discharge head at the terminal end thereof, e. the housing having a "U" shaped spout section with a pair of spaced side walls and a top and end wall extending between the spaced portions of the spaced side walls, f. a plurality of bosses formed in the housing along the inside surface of each of the side walls to terminate a short distance from the edge thereof, with a last pair formed adjacent the discharge end of the waterway, g. a pair of ribs formed on the throat plate extending upwardly adjacent to and inwardly of the end wall of the throat plate, and h. the pair of ribs to wedgingly engage the last pair of bosses in locking engagement therewith to connect and lock the throat plate with the housing and provide an interconnection therebetween without separate fasteners and to clamp the waterway assembly within the "U" shaped spout between the housing and the throat plate.

2. The faucet claimed in claim 1 which further comprises:

a. the throat plate having an arcuate outer end, b. the discharge head of the spout to be engaged by the outer end of the throat plate, c. an arcuate head boss formed in the end wall of the housing, d. the discharge head of the spout to be clamped between the head boss of the housing and the outer end of the throat plate upon the ribs of the throat plate being wedge locked to the bosses adjacent the end wall of the housing.

3. A housing assembly for a faucet with a "T" copper tube waterway assembly operated responsive hot and cold water valves to discharge water from the waterway comprising:

a. a hollow housing forming a "U" shaped upper body with a spout, b. a unitary lower body defining a throat plate and a putty plate, c. bosses formed on the inside of side walls of spout adjacent the terminal end thereof, d. the throat plate having a flat outerside and upwardly extending spaced ribs formed a short distance from its outer end, e. fastening members to connect the upper body and the lower body together at the putty plate of the lower body and the ribs of the throat plate to wedgingly engage the bosses of the housing spout to lock the throat plate to the upper body.

4. The housing assembly claimed in claim 3 which further comprises:

a. an arcuate outer edge formed at the outer end of the throat plate, b. a spout boss formed in the upper housing, c. the discharge head of the waterway spout clamped between the outer edge of the throat plate and the spout boss of the upper body of the housing upon the ribs of the throat plate wedgingly engaging the side bosses of the upper body.

* * * * *